US009139264B2

(12) United States Patent
Fuller

(10) Patent No.: US 9,139,264 B2
(45) Date of Patent: Sep. 22, 2015

(54) BOARD BOOSTER SYSTEM

(71) Applicant: Peter Fuller, New York, NY (US)

(72) Inventor: Peter Fuller, New York, NY (US)

( * ) Notice: Subject to any disclaimer, the term of this patent is extended or adjusted under 35 U.S.C. 154(b) by 0 days.

(21) Appl. No.: 14/031,003

(22) Filed: Sep. 18, 2013

(65) Prior Publication Data

US 2014/0080370 A1 Mar. 20, 2014

Related U.S. Application Data

(60) Provisional application No. 61/702,718, filed on Sep. 18, 2012.

(51) Int. Cl.

| | |
|---|---|
| ***B63B 35/81*** | (2006.01) |
| ***B63B 35/79*** | (2006.01) |
| ***B63B 35/71*** | (2006.01) |

(52) U.S. Cl.

CPC ..... *B63B 35/7906* (2013.01); *B63B 35/71* (2013.01)

(58) Field of Classification Search

USPC ..... 441/65, 75, 74, 79
IPC ..... B63B 35/7906,35/7926
See application file for complete search history.

(56) References Cited

U.S. PATENT DOCUMENTS

| | | | | |
|---|---|---|---|---|
| 6,007,393 | A * | 12/1999 | Choiniere et al. | 441/74 |
| 7,717,763 | B2 * | 5/2010 | Lei | 441/74 |
| 8,435,092 | B1 * | 5/2013 | Smith | 441/65 |

* cited by examiner

*Primary Examiner* — Stephen Avila
(74) *Attorney, Agent, or Firm* — Mintz Levin Cohn Ferris Glovsky and Popeo, P.C.

(57) ABSTRACT

The subject matter disclosed herein relates to a system for a water-going board that boosts the forward momentum of the board. This system may include a board having a bottom surface. The system may also include one or more cavities formed in the bottom surface of the board. These cavities may be configured to catch forward-moving energy of water moving forward relative to the board, while allowing passage of rearward-moving energy of water moving rearward relative to the board.

18 Claims, 1 Drawing Sheet

BOARD BOOSTER SYSTEM

CROSS REFERENCE TO RELATED APPLICATIONS

This application claims the benefit of priority under 35 U.S.C. §119(e) of U.S. Provisional Application No. 61/702,718, entitled "Board Booster System," filed on Sep. 18, 2012, the contents of which are incorporated herein by reference in their entirety for all purposes.

BACKGROUND

Some boards used in the water, such as stand-up paddleboards (SUPs), large surfboards, or the like, are very buoyant. For instance, most SUPs are thick and wide, and can support a rider while floating with its top surface entirely above the water. However, these boards, due to their size and shape, also experience a substantial amount of resistance in the water, which limits their speed and turning capabilities.

SUMMARY

This document describes a system to boost the forward momentum of a board, in particular a SUP.

In some implementations, the system includes a board having a bottom surface. The system further includes a number of contoured cavities or craters in the bottom surface of the board. The contoured cavities are formed and shaped to catch water moving forward relative to the board, i.e. the forward energy of a wave, for example, while allowing smooth passage along the underside of the board of water moving backward relative to the board, i.e., the rearward energy of a wave.

The details of one or more embodiments are set forth in the accompanying drawings and the description below. Other features and advantages will be apparent from the description, drawings, and claims.

BRIEF DESCRIPTION OF THE DRAWINGS

These and other aspects will now be described in detail with reference to the following drawings.

DETAILED DESCRIPTION

This document describes a booster system for a water-going board. The booster system is configured to boost the forward momentum of a board, in particular a SUP, by catching and using forward-directed energy, such as from a moving wave, current or the like, while allowing the board to smoothly glide over standing water or water moving rearward relative to the board.

Figure 1:
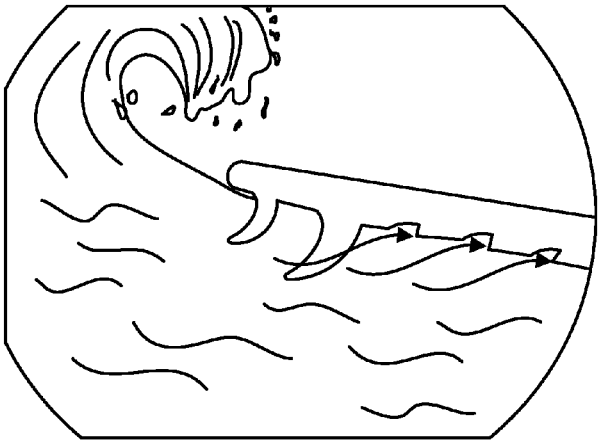
FIG. 1 is a side cross-sectional view of a board with a booster system.
Figure 2:
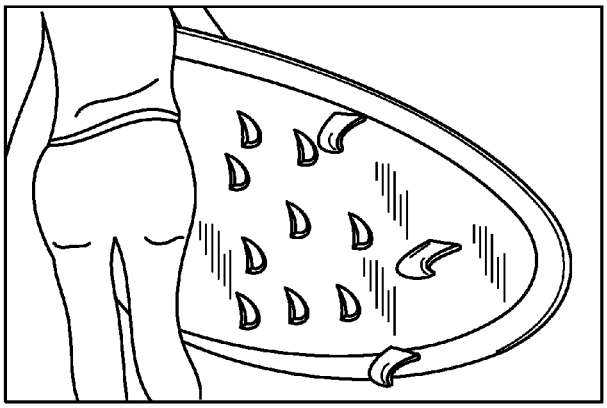
FIG. 2 is a bottom view of a board with a booster system.
Figure 3:
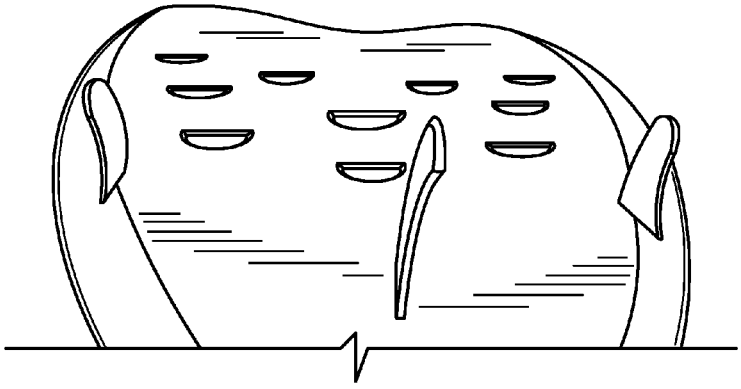
FIG. 3 is a rear perspective view of a board with a booster system.

As illustrated in FIGS. 1, 2 and 3, a booster system includes one or more cavities in a bottom surface of the board. In some implementations, the cavities originate at a surface of the board, while in other implementations, the cavities may have a slight lip with an angled forward section and a straight or concave rearward face. The one or more cavities can be provided in an array, such as in a pattern of two or more cavities.

In preferred implementations, the one or more cavities are provided in the board along the bottom surface nearer the tail of the board. However, the one or more cavities can be provided at any point of the board. To optimize catching forward energy of a wave, for instance, the one or more cavities are preferably featured at a middle to rear end toward the tail of the board, as the forward energy of the wave first contacts that region when a rider is attempting to ride a wave. In some preferred implementations, the cavities are formed behind an apex of a rocker of the board, if any is provided to the board. The one or more cavities will catch the forward energy within their contoured surface, to add forward momentum to the board.

Each cavity can be contoured to be shaped as a gradual, almost imperceptible slope inward of the bottom surface of the board, to a maximum depth, at which a wall or concavity can be formed for surface area exposure to the forward energy of the water. In some implementations, the cavities have a half-circle or half-oval outline from a view looking down on the cavities, but could also have a curved rearward face.

The cavities can have dimensions of 1 to 12 inches wide, 1 to 10 inches long, and a depth from the bottom surface of the board of ½ to 4 inches. In some implementations, the cavities can be formed by shaping a piece of foam, or blank, to include the cavities, which then can be sealed, or glassed, by a resin or other hardened surface. In other implementations, the cavities can be pre-molded out of a hard surface material, such as plastic, polyvinyl carbonate, fiberglass or carbon fiber, or the like, and then connected to the bottom of the board during the shaping process or post-shaping. Further still, the cavities can be added to the underside of the board after final shaping and manufacturing.

The cavities can be arranged in a pattern to maximize a surface area facing a rearward angle, or arranged to provide a predetermined surface area.

Although a few embodiments have been described in detail above, other modifications are possible. Other embodiments may be within the scope of the following claims.

What is claimed is:

1. A booster system comprising:

a board having a bottom surface; and one or more cavities formed in the bottom surface of the board, the one or more cavities:

configured to catch forward-moving energy of water moving forward relative to the board, while allowing passage of rearward-moving energy of water moving rearward relative to the board; and, comprising:

a substantially rearward facing wall configured to catch the forward-moving energy of water moving forward relative to the board;

a concave wall disposed substantially perpendicular to the rearward facing wall and configured to form an ever increasing cavity in the bottom surface of the board between a first portion of the concave wall and a second portion of the concave wall, the second portion of the concave wall engaging with the substantially rearward facing wall, the second portion of the concave wall spanning from a first side to a second side of the substantially rearward facing wall.

2. The booster system as in claim 1, wherein the board comprises a curvature and the curvature has an apex between a front end of the board and a rear end of the board, and the one or more cavities are disposed rearward of the apex.

3. The booster system as in claim 1, wherein the substantially rearward facing wall includes a protrusion extending beyond the bottom surface of the board.

4. The booster system as in claim 3, wherein the protrusion is angled forward and has a concave rearward face.

5. The booster system as in claim 1, wherein the one or more cavities are arranged in at least three rows extending from the rear of the board toward the front of the board and at least one middle row of the at least three rows of one or more cavities is set rearward of other rows of the at least three rows.

6. The booster system as in claim 1, wherein the one or more cavities have a half-oval profile.

7. The booster system as in claim 1, wherein the one or more cavities are carved into the bottom surface of the board.

8. The booster system as in claim 1, wherein the one or more cavities are pre-formed and installed into the bottom surface of the board.

9. The booster system as in claim 1, wherein the one or more cavities are disposed in the bottom surface of the board, such that individual ones of the one or more cavities are offset compared to other cavities of the one or more cavities to maximize the surface area of the rearward facing walls of the one or more cavities that can catch forward moving energy of water.

10. A method for providing a board having a booster system, the method comprising:

providing a board having a bottom surface; and installing one or more cavities formed in the bottom surface of the board, the one or more cavities:

configured to catch forward-moving energy of water moving forward relative to the board, while allowing passage of rearward-moving energy of water moving rearward relative to the board; and, comprising:

a substantially rearward facing wall configured to catch the forward-moving energy of water moving forward relative to the board;

a concave wall disposed substantially perpendicular to the rearward facing wall and configured to form an ever increasing cavity in the bottom surface of the board between a first portion of the concave wall and a second portion of the concave wall, the second portion of the concave wall engaging with the substantially rearward facing wall, the second portion of the concave wall spanning from a first side to a second side of the substantially rearward facing wall.

11. The method for providing a board having a booster system as in claim 10, wherein the board comprises a curvature and the curvature has an apex between a front end of the board and a rear end of the board, and the one or more cavities are disposed rearward of the apex.

12. The method for providing a board having a booster system as in claim 10, wherein the substantially rearward facing wall includes a protrusion extending beyond the bottom surface of the board.

13. The method for providing a board having a booster system as in claim 12, wherein the protrusion is angled forward and has a concave rearward face.

14. The method for providing a board having a booster system as in claim 10, wherein the one or more cavities are arranged in at least three rows extending from the rear of the board toward the front of the board and at least one middle row of the at least three rows of one or more cavities is set rearward of other rows of the at least three rows.

15. The method for providing a board having a booster system as in claim 10, wherein the one or more cavities have a half-oval profile.

16. The method for providing a board having a booster system as in claim 10, wherein the one or more cavities are carved into the bottom surface of the board.

17. The method for providing a board having a booster system as in claim 10, wherein the one or more cavities are pre-formed and installed into the bottom surface of the board.

18. The method for providing a board having a booster system as in claim 10, wherein the one or more cavities are disposed in the bottom surface of the board, such that individual ones of the one or more cavities are offset compared to other cavities of the one or more cavities to maximize the surface area of the rearward facing walls of the one or more cavities that can catch forward moving energy of water.

* * * * *